United States Patent [19]

Lang

[11] Patent Number: 4,653,956

[45] Date of Patent: Mar. 31, 1987

[54] HIGHWAY PAVEMENT

[76] Inventor: Frederic A. Lang, c/o Connolly and Hutz 1220 Market St. P.O. Box 2207, Wilmington, Del. 19899-2207

[21] Appl. No.: 680,955

[22] Filed: Dec. 12, 1984

[51] Int. Cl.[4] ..... E01C 7/00; E01C 11/14

[52] U.S. Cl. ..... 404/28; 404/30; 404/31; 404/53; 404/62; 404/58

[58] Field of Search ..... 404/17, 27, 28, 30, 404/31, 32, 47, 53, 55–58, 62, 67; 52/396, 573; 14/16.5

[56] References Cited

U.S. PATENT DOCUMENTS

| | | | |
|---|---|---|---|
| 2,013,195 | 9/1935 | Ward | 14/16.5 |
| 2,181,018 | 11/1939 | Hughes et al. | 404/47 |
| 2,183,253 | 12/1939 | Chambers | 404/31 |
| 2,588,609 | 3/1952 | Blackhall | 404/56 |
| 2,839,973 | 6/1958 | Heltzel | 404/53 X |
| 3,000,276 | 9/1961 | Foulger | 404/82 X |
| 3,194,129 | 7/1965 | Finsterwalder | 404/56 |
| 3,646,748 | 3/1972 | Lang | 57/223 |
| 3,797,188 | 3/1974 | Mansfeld | 404/47 X |
| 3,986,781 | 10/1976 | Conde et al. | 404/31 |
| 4,212,558 | 7/1980 | Lang | 403/41 |
| 4,296,207 | 10/1981 | Siegmund | 404/17 X |

FOREIGN PATENT DOCUMENTS

| | | | |
|---|---|---|---|
| 2923939 | 12/1980 | Fed. Rep. of Germany | 404/17 |
| 351685 | 7/1931 | United Kingdom | 404/28 |

*Primary Examiner*—Stephen J. Novosad
*Assistant Examiner*—John F. Letchford
*Attorney, Agent, or Firm*—Harold Pezzner

[57] ABSTRACT

A highway pavement of concrete slab-on-grade surface includes a prestressed portland cement concrete surface layer which is mounted on a non-freezing low restraint support grade layer without any linear physical connection thereto in such a manner as to permit freedom of movement toward the midpoint of the surface layer. The surface layer is thereby able to slide in response to temperature and moisture changes in the environment including at temperatures below the freezing point of water. The surface layer has a riding surface of generally the same rideability five years after installation as it does at the time of installation.

12 Claims, 11 Drawing Figures

HIGHWAY PAVEMENT

BACKGROUND OF THE INVENTION

My invention pertains to the design and construction of concrete slabs-on-grade which are used for tennis courts, driveways, highways, railway roadbeds and many other uses including interstate and airport pavements having heavy loads and frequent travel thereon. Such surfaces are hereinafter referred to as highway pavements. To overcome a multiplicity of quality and cost problems with the concrete slabs of the prior art, I have invented a simple and low-cost product and method for installing a total system which utilizes the tensile strength of the concrete rather than the strength of steel to maintain an acceptable surface for traffic.

Portland cement concrete (hereinafter referred to as concrete) has long been used for tennis courts, driveways, highways and airport runways because of its volumetric in-place economy and desirable physical properties. Hopefully, this concrete is a surface structure which supports the traffic whether the traffic is a tennis player, an industrial lift-truck, an automobile or a tractor-trailer truck. However, objectionable roughness from cracks and joints has impeded and slowed traffic and has required extra motive energy. Also roughness has accelerated the deterioration of vehicles. The results to date have been disheartening.

Unfortunately, prior to my invention, engineers have failed to design a tennis court as single concrete slab rather than a multiplicity of smaller slabs having joints or cracks between the slabs. In the prior art, a tennis court usually is a grouping of five to twenty slabs. Also highways typically have joints, by choice of the expert pavement design engineers, every 12, 20 or 45 feet and often cracks every 2 to 10 feet within several years of the time of installation.

Perhaps the most objectionable physical characteristic of concrete is a change of volume and dimension that is related to temperature and wetness. Concrete made using most cements, particularly those otherwise suitable for slabs, shortens with drying and a declining temperature as described in "Highway Engineering Handbook" and "American Concrete Institute" publications. Repeated shrinkage with falling temperature occurs after rising temperatures cause concrete expansion.

This objectionable shrinkage of concrete causes shrinkage cracks when a concrete pavement as large as a tennis court is "connected" to its supporting structure, as in prior art pavements, and is restrained during shrinkage to such an extent that the tensile force exceeds the tensile strength in the concrete. The result is a cracked slab. Of course, any traffic load on the slab is an added consideration because the restraint tension and the bending tension on the lower surface are additive.

The placing of reinforcing steel bars in the concrete is of no merit in preventing shrinkage cracks because the steel cannot shrink like the concrete during concrete drying and, as a result, the steel further restrains the concrete during drying shrinkage. Such steel actually increases shrinkage cracks.

The prior art in respect to concrete slab-on-grade restraint is exemplified by Subcommittee IV, Committee 325 report published in "Journal of the American Concrete Institute" V28, No. 4, October, 1956. A coefficient of friction of 1.5 is said to be typical for the restraint between slabs and their base. Attempts to obtain lower restraint of slabs have included use of a sand layer one inch thick below the slab with the coefficient remaining near 1.0. Later Pennsylvania Department of Transportation in 1973–74 near Hogestown installed concrete slabs over two layers of polyethylene film and thereby expected to lower the coefficient of friction to a 0.65 to 1.0 range although the data leave the actual friction coefficient obscure.

Foulger U.S. Pat. No. 3,000,276 suggests the use of at least two sheets of polymeric film (high density polyethylene) between the base and the concrete slab. The polyethylene films may have a slip agent in the polymer so as to give an interfacial coefficient of friction of the order of 0.24 to 0.13. The Foulger patent suggests that the polyethylene sheet assembly of two sheets may consist of a length of flattened tubing.

The prior art appears silent on a method for reducing slab restraint involving reduced machanical interlocking of the slab on its support structure. A plan was underway in Mississippi in 1976 to use an aggregate-bituminous mix below a slab. This mix should be an aid toward less slab restraint but still in the 0.6 to 1.0 range of friction coefficient is expected.

By making slab dimensions small, the typical tennis court and highway builder has avoided much of the shrinkage crack problem but at the same time has incurred a slab with many joints plus possible cracks. Joints and cracks normally require some means for sealing out rainwater and for vertical alignment. Hence serious new problems result from smaller slabs. Because water enters the support structure at joints and cracks and destroys the firmness of that support, the pavement in the zone near joints and cracks cannot support traffic loads the same as at the middle of a slab. Even major upgrading of the underlying support structure causes a serious cost problem and does not solve the problems caused by cracks and joints.

A recent development of merit is prestressed concrete slabs wherein relatively large prestress forces are used to close cracks tightly and to make the cracks non-functionable thereby reducing the water sealing and vertical alignment problems except at the joints every 400, 500 or 600 feet. To aid in obtaining the desired prestress force such slabs also have been placed on two layers of polyethylene.

In all cases where two or more sheets of polymeric film are used the desired results might be obtained as long as the annual frost line is less than the thickness of the concrete slab. However, in areas where the annual frost line is greater than than thickness of the slab the freezing of water that accumulates as liquid or vapor between the layers of polymeric film tacks the two sheets of film together so that the desired result of reduced friction and low restraint between the base and the concrete slab is lost. This occurs even with the flattened tubing suggested by the Foulger patent as the tubing edges are torn when the concrete slab expands and contracts while resting on one side of the tube.

All of these attempts have not solved the problem of obtaining slabs-on-grade that have satisfactory in-service smoothness at desirable cost. Perhaps the best source of information on prior art is "Highway Engineering Handbook", K. B. Woods, Editor-in-Chief, First Edition 1960, McGraw-Hill Book Company, New York, N.Y.

SUMMARY OF THE INVENTION

It is an object of my invention to provide a slab-on-grade surface structure for highway pavements accomplished by overlaying a support structure of the prior art type with an entirely new concept of large continuous concrete surface structure.

Another object is to provide a surface structure of the following characteristics:

1. Homegeneous concrete unjointed and generally uncracked in lengths of 100 feet to 200 feet; and 2. Very low restraint between the concrete surface structure and the support structure whenever the concrete surface structure needs to change horizontal dimensions to relieve thermal or other stresses.

In accordance with this invention, the highway pavement is of the concrete slab type which includes a surface layer of prestressed concrete mounted on a non-freezing low restraint support grade layer without any physical connection thereto in such a manner as to permit freedom of movement to and from the midpoint of the surface layer. Accordingly the surface layer is able to slide in response to temperature and moisture changes in the environment including movement at temperatures below the freezing point of water.

In a preferred practice of this invention, antifreeze means are provided between the surface layer and the support layer in addition to anti-friction means to facilitate the surface layer having the same rideability many years after its installation as it did at the time of installation.

The above objects are accomplished by molding a smooth lower face when the newly mixed concrete of the surface structure is placed on the support structure and by having at least two layers of sheet material between the two structures, at least one interface between layers of said sheet material having a film of an organic liquid between the layers, said organic liquid having a melting point below about −12° C. and a boiling point of at least 150° C. and further having anti-friction properties between the layers to provide a friction coefficient less than 0.4 between the concrete slab and its base support structure.

The present invention also provides a contraction joint which may be incorporated in the highway pavement structure.

THE DRAWINGS

DETAILED DESCRIPTION

Figure 1:
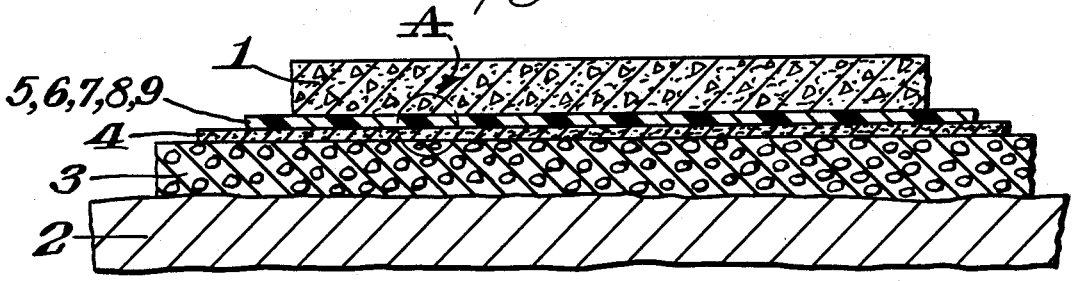
FIG. 1 shows a cross-section of a slab-on-grade incorporating features of my invention.

The present invention is directed to providing a highway pavement which has a riding surface of generally the same rideability many years after its installation as it does at the time of installation. In order to accomplish this purpose, the present invention takes into account the factors which generally lead to a breakdown in the riding surface. Such breakdowns are usually manifested by potholes, bumps, cracks, discontinuities or the roadway being out of service because of repairs. With conventional roadways, the surface material disintegrates from a number of different causes. For example, the tensile forces caused by wheel loads might exceed the tensile strength of the concrete. There might be a high tensile force due to thermal shrinkage, drying shrinkage, curl or warping, lack of base support. Conventional highway pavements have cracks and permit water to enter the base layer.

The present invention avoids high tensile forces by various measures. For example, the surface layer is mounted on the support layer without any linear connection in such a manner that the surface layer is free to slide toward its midpoint. if desired, the surface layer may be anchored at the midpoint. When the surface layer is formed in a multiple of slabs, however, a key feature is that the slabs are placed end to end without being otherwise anchored. The sliding movement is facilitated by incorporating anti-friction means between the surface layer and the support layer. Additionally, to function in environments having temperatures below the freezing point of water, anti-freeze means are also incorporated between the moving layer and the support layer.

The anti-freeze means may take various forms such as the utilization of an organic compound which preferably, as later described, would be placed between multiple sheets of plastic material. Another form would be the utilization of an inorganic solid material which is soluble in water. A sand layer may be provided between the surface layer and the support layer, and a concentrated dose of salt may be incorporated in the sand layer to function as the anti-freeze means.

The anti-friction or low friction means could be in the form of a plastic film underlay or through the use of spherical particle base material or through the use of base material with low shear values.

The practice of the invention would result in the same type of rideability for the support surface for many years after its installation including two years, five years, ten years, fifteen years, so as to avoid the cost and inconvenience now presently encountered with conventional highway pavements. For comparison of rideability, reference might be made to the American Concrete Paving Association standards for rideability issued in 1984. For example, rideability may be initially measured and then years later the same method may be used for comparison.

Where the invention uses an organic liquid for anti-friction properties, the organic liquid may be either water miscible or water immmiscible and should melt at a point below the temperature of the frozen earth below the concrete slab. Examples of such organic liquids that are commercially available are:

diethylene glycol
ethylene glycol
propylene glycol
tributyl phosphate
tributyl citrate
diethylene glycol mono ethyl ether
ethylene glycol mono ethyl ether
dibutyl perthalate
diacetone alcohol
diamyl phthalate
diethyl phthalate
tri methyl phosphate In FIG. 1 a concrete slab-on-grade surface structure 1 is above earth 2 and crushed stone 3. The crushed stone support structure 3 is covered with a layer of sand-bituminous mix 4. Above these are placed in sequence a layer of spunbonded sheet 5, a layer of polyethylene film 6, a layer of organic liquid 7, another layer of polyethylene film 8 and another layer of spunbonded olefin 9. The concrete 1 is entirely free of cracks and discontinuities in length and width between two adjacent contraction joints not shown.

Figure 2:
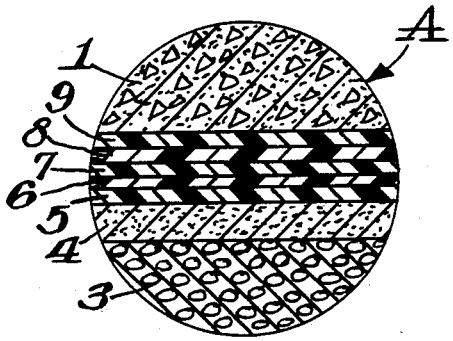
FIG. 2 is an expanded cross-section of the area within the area A of FIG. 1.

FIG. 2 is an expanded section of circle A of FIG. 1 to show the specific layers 5 through 9 as described above.

Figure 3:
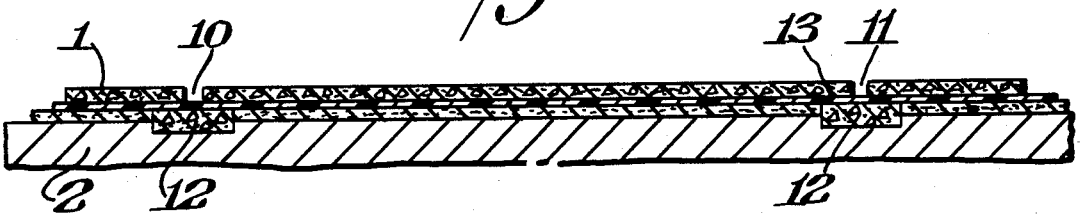
FIG. 3 shows a vertical cross-sectional view of a concrete slab-on-grade without refinforcement.

In FIG. 3 the slab 1 is shown to have contraction joints 10 and 11 at opposite ends of the slab and a means for vertical alignment at the joints consisting of a sleeper slab 12. Depending on structural needs at the slab end, reinforcing steel 13 may be embedded in concrete surface structure near the slab ends.

Figure 4:
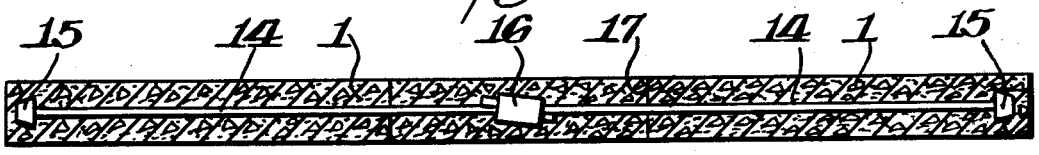
FIG. 4 shows a vertical cross-sectional view of a concrete slab-on-grade with post-tensioned cable.

In FIG. 4 an unbonded post-tensionable tendon 14 has been embedded in the layer of concrete 1 from one end to the other with a ÞDead-end" anchor 15 at both ends. Near the midpoint of the concrete, a special strand coupler 16 described hereinafter may be embedded in a concrete filled cavity 17 in the concrete slab 1.

EXAMPLES

The following example specifically illustrate my invention.

EXAMPLE A

A nearly level section of an existing automobile driveway 200 feet long by 8 feet wide has become uneven at its surface because of shrinkage cracks at one foot to four foot intervals. Because of the unevening, it must be resurfaced. It is composed of asphalt and aggregate which is analyzed structurally and found to be suitable as a support structure and can be overlayed with a new surface structure. To add a new top layer of asphalt and aggregate would lead to new top layer shrinkage cracks after five to ten years, and these cracks and uneven surfaces would cause a future rough traffic surface. Therefore, that procedure is costly and unacceptable.

My invention may be used to provide a concrete surface structure that can be expected to always provide a smooth surface with little or no cracks over its entire length for 100 years without any measurable maintenance cost during that time. To accomplish this, the following describes one method of carrying out my invention:

Below the top level of and at each edge of the existing driveway, a perforated two inch diameter plastic drain pipe is buried in crushed stone in a six inch by six inch cross section ditch to collect and remove surface water in the vicinity of the driveway. Then a sand bituminous mix is spread and rolled with a five ton roller to cover existing surface cracks and to aid in making a smooth underside on the subsequently placed concrete slab. Then a two layer roll of low friction materials nine foot wide is rolled the full 200 foot length of the planned slab. The two layers consist of a flattened tube of six mil thick unpigmented polyethylene containing propylene glycol between the layers.

Wooded forms are erected and 4000 psi strength and 2½ inch slump concrete is placed and finished over the 200 foot by eight foot area to a depth of four inches in a continuous pour. Immediately, polyethylene film is placed tightly over the concrete to prevent excessive water evaporation. The forms are removed gently before the concrete temperature falls more than 10° F., thereby avoiding form work restraint on the concrete while shrinkage takes place. When the concrete reaches a compressive strength of 3000 psi, automobile traffic over the driveway commences. During a typical warm day to cool night temperature swing of 30° F., the concrete slab-on-grade is observed to change length at each end with the middle of the concrete slab 200 foot length remaining stationary. Later a push-pull dynamometer may be linked to one end of the slab and to a fixed base, causing all of the thermal expansion and contraction to take place a the opposite unfixed end, thereby providing means for determining the coefficient of friction. For example, if during a 24 hour temperature cycle, the dynamometer will indicate approximately a 24,000 pound push and pull force generated by the thermal expansion and contraction motion and by the frictional engagement through the two layers of anti-friction material with a liquid layer between said layers. The computed weight of the slab is 80,000 pounds and by dividing the 24,000 pounds by this weight to give a coefficient of 0.3.

The cross-sectional area of this slab is eight feet by four inches which is 384 square inches. Therefore the pull force of 24,000 pounds during thermal contraction creates a unit tensile force of 62 pounds per square inch (psi). The slab consisting of 4000 psi compressive strength concrete has a theoretical tensile strength of approximately 7.5 times the square root of $F_c$ or 474. Therefore, the tensile strength exceeds the tensile stress caused by shrinkage by a margin 474 minus 62 or 412 pounds. After the dynamometer is disconnected and the slab returned to a normal surface structure function, the shrinkage force pulls the ends of the slab again toward the center of the slab length, therefore only one-half of the slab weight causes restraint, and the restraint force is 31 psi instead of 62 psi. Then the strength margin is available to carry traffic loads. The prior art teaches the analytical methods for determining the effect of bending moments.

EXAMPLE B

Prior art is used to install an adequate support structure one mile long by 24 feet wide plus shoulders consisting of aggregate-cement mix having a total thickness of 8 inches. The design of the support structure considers highway wheel loads, volume of traffic, soil mechanics, cost and other factors. A one inch layer of sand-bituminous mix is spread and rolled with a ten ton tandem roller. After preparation in a factory, a four layer roll of sheet materials 25 feet wide is unrolled over the prepared support structure and stapled in place outside the area to be paved. The four plys are two layers of polyethylene with ethylene glycol between said layers and a layer of spunbonded polyethylene above and below the polyethylene film. Slip-form type concrete paving machines are used to place a 4500 psi strength concrete five inches thick, 24 feet wide for the one mile length without any embedded steel reinforcement. The concrete slab weighs 63 psf. At time of placement no transverse or other joints are installed. After the concrete is at least two hours old but before its temperature drops more than 10° F., a concrete saw is used to cut the concrete through the five inch thick by 24 foot wide section at six locations to create seven structural surface concrete slabs each approximately 750 feet long.

As soon as placed, the concrete is protected with spunbonded polypropylene coated with polyethylene as a moisture and temperature barrier thereby enhancing the curing conditions for the concrete and insuring that the tensile strength of the concrete always is higher than the tensile stresses resulting from temperature and moisture changes. Prior to placing the highway in service, a bituminous solution or dispersion impregnation is made on the support structure 12 inches deep by 25 feet wide by 10 feet long centered below the saw cut in the concrete surface structure. Also an elastomeric tube filled with resilient foam is compressed and inserted into the contraction joint gap to seal the joint against water and dirt intrusion.

The slab-on-grade has a smooth under surface and the friction coefficient of the sheet materials used in this example when measured in the manner described in EXAMPLE A will be found to be 0.35 to 0.25 or an average of 0.30. The tensile force created by shrinkage is one-half of the slab weight (because the slab shrinks at both ends toward the middle) times the coefficient of friction or 750/2 times 24 times 63 times 0.3 equals 170,100 pounds. This force is exerted on the slab cross-section near its mid-length section which has an area of 24 times 12 times 5 or 1440 square inches. The unit force is 170,100/1440 or 118 psi or well below the expected tensile strength of 503 psi for this concrete. Of course the tensile force created by shrinkage at the ends of the slab is zero, and when the slab is expanding with a temperature rise the restraint unit force of 118 psi is additive to the 503 psi tensile strength at the mid-length of the slab. Therefore, the available tensile strength under that condition is 503 plus 118 or 621 psi which is greatly in excess of any tensile forces created by normal wheel loads. This concrete surface structure slab remains uncracked, imparts excellent riding characteristics to traffic and provides an economical surface structure for an expected 100 years.

EXAMPLE C

The methods of EXAMPLE B are used as stated with the exception that 5000 psi concrete is used. After the 24 foot wide and one mile length of concrete surface structure is in place, within ¼ hour of the time the concrete in each region is first screened, portions of three post-tensionable tendons, 0.6 diameter, 270,000 psi grade steel, each one mile long, are embedded longitudinally in the concrete and spaced at two feet, 12 feet and 22 feet from one edge of the concrete and ½ inch below the middle of the five inch thickness. The surface of the concrete is smoothed after embedding the tendons. As the tendons are embedded permanent anchorages are placed on each tendon on each side of the planned saw joints, and the concrete there is also smoothed. After the concrete is at least two hours old but before its temperature drops more than 10° F., a concrete saw is used to cut the concrete through the five inches by 24 foot section at three planned locations to create four concrete structural surface slabs each 1320 feet long between sawed joints. To prevent tensile forces due to thermal and curing shrinkage and from traffic loads in excess of concrete tensile strength, the three tendons are tensioned permanently by using the following method on one tendon at a time at a mid-slab location. A power saw with a circular abrasive blade is used to saw through most of the concrete along lines that scribe a rectangle six inches by 30 inches centered horizontally along the axis of the tendon without cutting the tendon. The concrete is removed from the area with a pneumatic hammer. The tendon is cut, jacked, anchored and embedded in concrete using the coupler described hereinafter. The remaining concrete is protected during curing and the contraction joint area is treated as described under EXAMPLE C.

This slab has a tensile force created by shrinkage of 1320/2 times 24 times 63 times 0.30 or approximately 299,000 pounds. The cross-sectional area exposed to this force is 24 times 12 times 5 or 1440 square inches. Prior to any wheel loads being placed on the slab, the post-tensioning of the three tendons to an effective long term force of 35,000 pounds each created a compression of 35,000 times 3/1440 or 73 psi, which acts in combination with the tensile strength of the concrete of 500 psi to give a total strength of 573 psi. The tensile stress caused by shrinkage is 299,000/1440 equals 207 psi, but this stress is sufficiently below the strength of 573 psi to prevent cracks in the 1320 foot long slab of concrete.

The ratio of longitudinal compressive forces in psi produced by the three cables to the length of the surface structure in feet is 73/1320 equals 0.055.

SLAB THINNESS

Shifting of earth below slabs-on-grade cannot be eliminated entirely, therefore, it is desirable, as provided by my invention, that slabs-on-grade have modest thickness, thereby making the slab more flexible and able to change to a new generally lower elevation of the support structure while maintaining lower bending stresses inherent in their thinness. Of course, vibratory motion induced by thinness must be considered but does not appear of concern in highways when thickness of slab is five inches plus or minus perhaps one inch.

SLAB CURL

The problem of slab upward curl at the slab perimeter usually is favored by placing the slab on polyethylene film and by reduced slab thickness because moisture gradients vertically in the slab are less pronounced. Reduction of slab curl at the slab ends is a valuable contribution toward slab performance.

FEWER CONTRACTION JOINTS

My invention establishes as obtainable and economical a much greater length and area of slabs. In highways, this means fewer contraction joints which always will, by design, exist between adjacent slabs. Fewer joints allow more comprehensive design and construction of contraction joints. I find two types of special value. One is a concrete "sleeper" slab which is used in certain applications already and which, in spite of its cost, is desirable because it controls the vertical movement of the slab ends without depending on dowels or other mechanical interlocking devices for transmitting wheel load shear. Other satisfactory joints are well known to pavement designers.

FIGS. 5–8 show a contraction joint 20 in accordance with this invention. as indicated therein, contraction joint 20 comprises a pair of beams 22, 24 such as I-beams each of which is associated with a pavement slabs or surface layers 26, 28. The pavement slabs 26, 28 would correspond to the previously described surface structure 1 and contraction joints 20 would be used in the arrangement such as indicated in FIG. 3 wherein the contraction joints 10, 11 are shown.

During installation, slabs 26, 28 would be in end to end relationship with beams 22, 24 generally juxtaposed each other. As previously described, each slab end moves toward and away from the slab midpoint as the slab expands and contacts. During this movement, beams 22, 24 would also move toward and away from each other.

Figure 6:
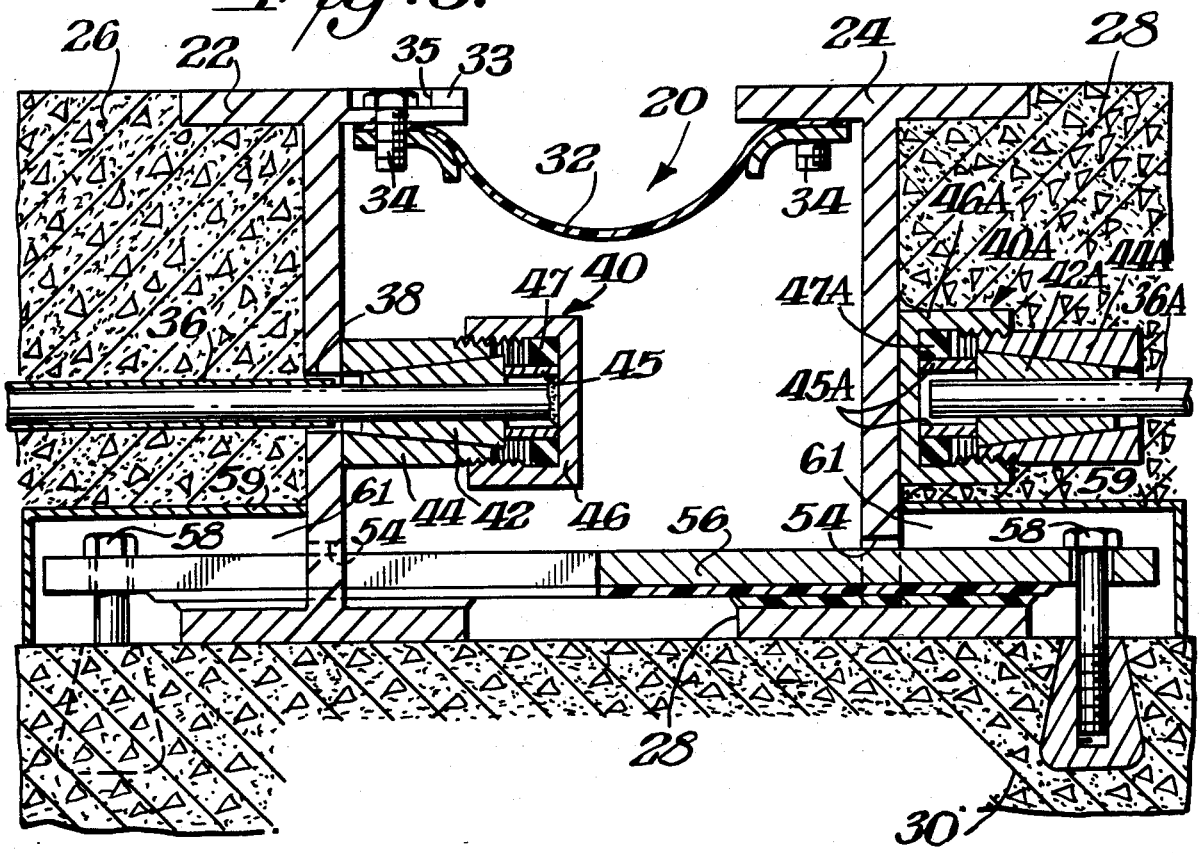
FIG. 6 is a cross sectional view taken through FIG. 5 along the line 6—6.
Figure 8:
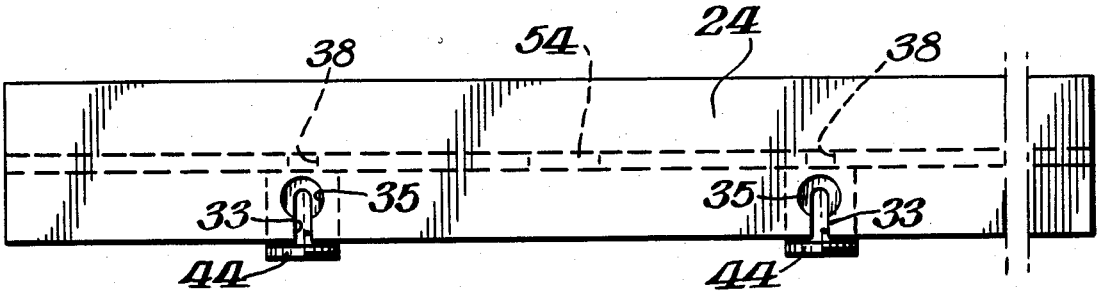
FIG. 8 is a top plan view of the contraction joint of FIG. 7.
Figure 7:
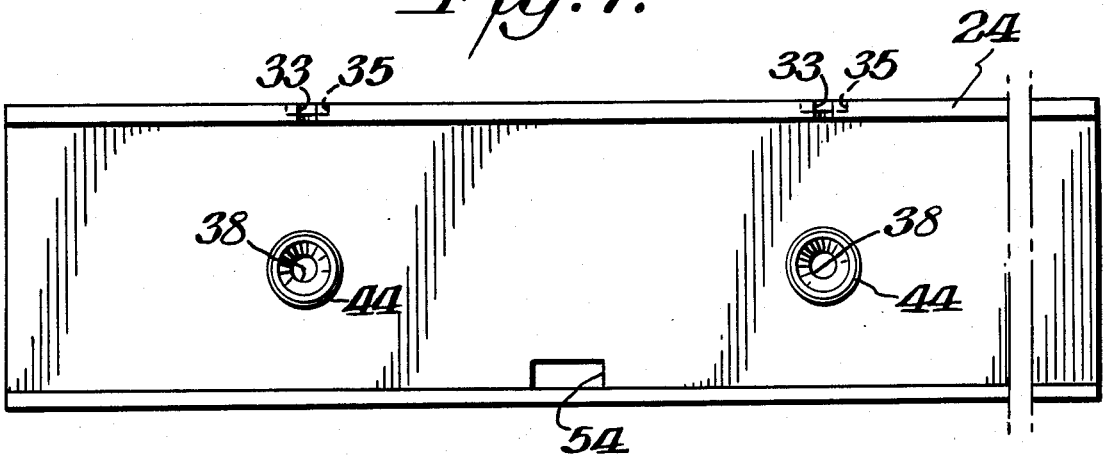
FIG. 7 is a side elevation view of a portion of a contraction joint in accordance with this invention.

As shown in FIG. 6, contraction joint 20 would also include a low restraint under pavement 26, 28 of the type previously described. In addition, a sleeper slab 30 would be arranged beneath the beams 22, 24 with the sleeper slab located on the pavement base in the manner illustrated in FIG. 3.

In accordance with this invention, an adjustable sealing member 32 is tightly connected to each beam 22, 24 so as to span the space between the beams at generally the upper surface thereof and thereby sealing the distance between adjacent slabs so as to exclude water and dirt from entering the space below. Sealing member 32 is made of any suitable material such as neoprene or Hypalon to form a diaphram which as shown in FIG. 6 is capable of moving as the beams move to increase or decrease the space therebetween. This could be accomplished by securing the flexible diaphram 32 to the beams 22, 24 in any suitable manner such as by spaced fasteners 34. Fasteners 34 initially slide in slots 33 in the beams and then drop into recesses 35 so as to not protrude above the top of the beams.

As shown in FIG. 4, one of the features of this invention is to include a post-tensionable tendon in the surface layers or slabs. The ratio of longitudinal compressive forces in psi produced by the tendon to the length of the surface layer is less than 0.25. The expansion joint of this invention provides for tensioning the tendon and then anchoring the tendon preferably by anchoring the tendon to a beam. This may be accomplished in various manners.

FIG. 6 illustrates two manners of anchoring post-tensionable tendon 36 to the beams 22, 24. As illustrated therein, in one technique the tendon 36 is secured to the outer surface of the beam. A hole 38 is formed in beam 22 of a size and location to permit a respective tendon 36 to be inserted therethrough. An anchoring device 40 which includes wedge members 42, externally threaded boss 44 and internally threaded cap 46 is provided on beam 22 at the side thereof remote from its slab 26. Cap 46 is permanently connected to tendon 36 as by welding, and boss 44 is threaded thereon. Cap 46 includes an annular flange 45 for pressing resilient ring 47 against the wedges 42. Any suitable form of anchoring member may be used such as described in my U.S. Pat. No. 4,212,558.

FIG. 6 also illustrates a manner of anchoring tendon 36A to the inner surface of the beam. As illustrated, anchoring device 40A is the mirror image of anchoring device 40. Thus anchoring device 40A also includes internally threaded cap 46A welded to beam 24 with boss 44A threaded therein. Anchoring device 40A also includes wedge members 41A, ring 45A and during 47A.

In the preferred practice of this invention, a plurality of tendons are provided in each slab 26, 28 across the width thereof. As shown in FIG. 1, the tendons in the respective slabs, however, are not aligned with each other so that an offset arrangement with the tendons of one slab are created with respect to the tendons of the other slab.

Figure 9:
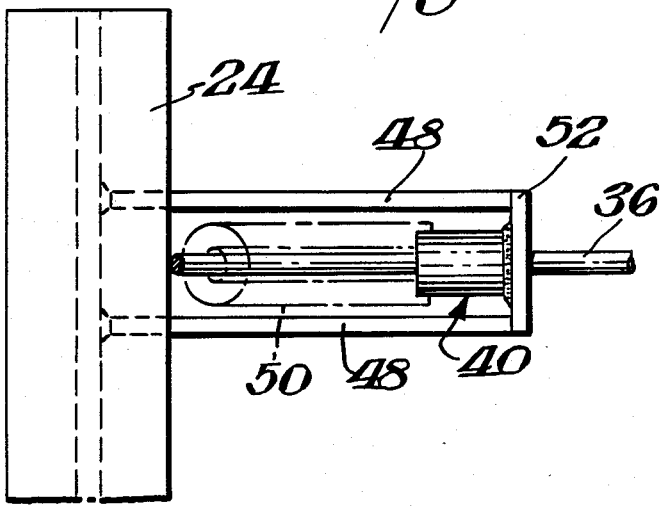
FIG. 9 is a top plan view partly in section of a modified contraction joint in accordance with this invention.
Figure 10:
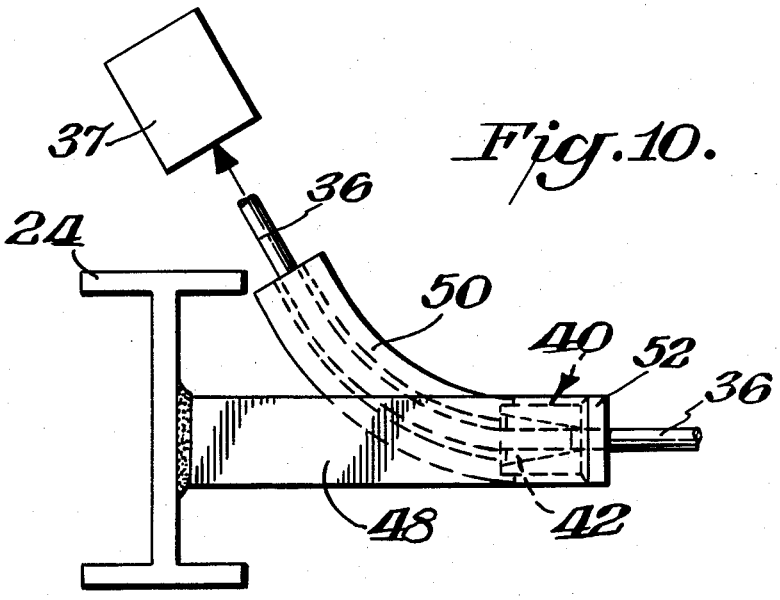
FIG. 10 is a side elevation view of the contraction joint of FIG. 9.
Figure 11:
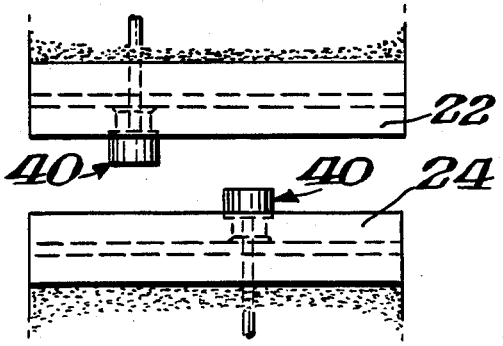
FIG. 11 is a top plan view of a contraction joint in accordance with this invention showing offset tendons.

FIGS. 9–10 also illustrate an arrangement to permit the tensioning of tendon 36. As shown therein, the anchoring arrangement could be in the form of a pair of spaced side members 48, 48 which are rigidly secured to I-beam 24. An anchoring device 40 with wedges 42 are located at the end plate 52 connecting the side members. A curved tube 50 is also temporarily disposed in the space between the side members. Tube 50 extends upwardly to a point above the upper surface of the pavement. Tendon 36 would extend outwardly from tube 50 wherein it could be connected to a suitable hydraulic device 37 or other tensioning device which would pull on the tendon 36 to tension the tendon and then the tendon would be anchored in its tensioned condition. Tube 50 and excess tendon length would later be removed and the space occupied by the tube would be filled with concrete.

Figure 5:
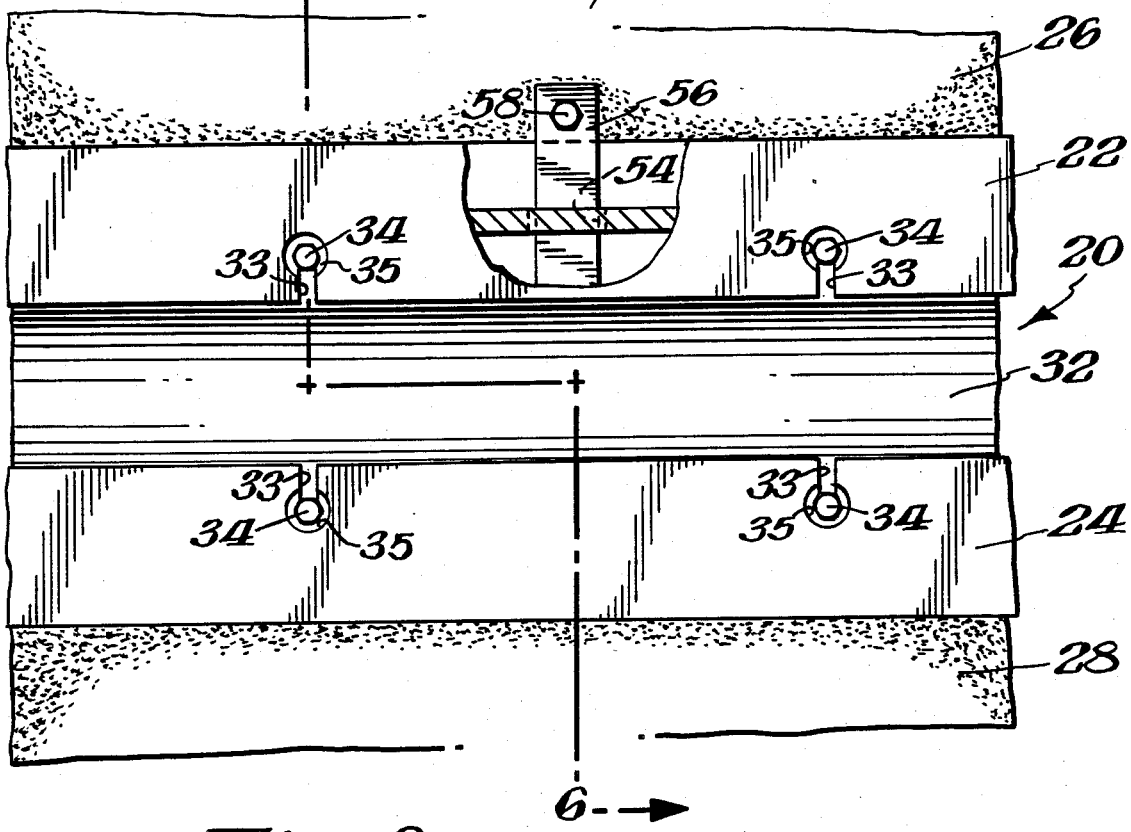
FIG. 5 is a plan view partly broken away and in section of a contraction joint in accordance with a further aspect of this invention.

FIGS. 5–6 further illustrate the structure utilized in the expansion joint 20 to provide desired rideability. As shown therein, the beams 22, 24 include aligned openings 54 at the lower portion thereof. A hold-down bar or plate 56 is inserted through openings 54 so as to span the beams 22, 24. The ends of hold-down bar 56 are then anchored to sleeper slab 30 by the use of any suitable fastener 58. As shown in FIG. 6, a cavity 61 is formed around fastener 58 by sheet metal plates 59. Although not shown, an access hole would be provided to cavity 61 to permit periodic adjustment of fastener 58 as may be necessary from time to time. The space between beams 22, 24 would also be partially filled with grease. Hold-down bar 56 is made of sufficient length and is mounted to sleeper slab 30 at locations which permit the movement of beams 22, 24 toward and away from each other. Similarly sealing member 32 is of a length which is greater than necessary to cover the space between the beams 22, 24 when the beams are at their maximum spread from each other. It is to be understood that although I-beams are illustrated herein, the term "beams" is intended to include any structure which is functionally equivalent and would serve the purpose of providing supports for the sealing member and anchoring devices. It is within the broad concept of this invention, therefore, that the outer edges of the slabs themselves might function as the beams.

DEFINITIONS

The following definitions apply to the previously quoted words.

"Concrete" refers to portland cement concrete consisting of cement of Type I, II, III or IV and others combined with sand, gravel, stone, water and additives such as polymers, sulfur, fibers and chemicals that enhance the handling and quality of the concrete.

"Slab-on-grade" is a rigid surface structure. Such slabs overlay and are fully supported on the bottom surface by a material of lower strength. Slabs-on-grade provide more support and less deformation under wheels and other superimposed loads than that provided by clays and other soils. Slab-on-grade normally has nearly uniform thickness, a horizontal dimension considerably greater than said slab thickness, and absence of concrete walls and beams connected firmly to the slab.

"Unjointed" slabs-on-grade are continuous in composition and structure whereas a jointed slab could be a slab that has a cut or preformed discontinuity and perhaps a means such as steel bars for aligning adjacent slabs across the discontinuity.

"Crack" is a discontinuity in the slab occurring after concrete placement. At some time a crack has a finite dimension horizontally as it opens from the top surface to the bottom surface of the slab. A crack prevents a slab from sustaining tensile forces perpendicular to the crack.

"Smooth" as used to describe the under surface of the concrete slab-on-grade is a measure of surface irregularities and is applied to a surface that has no radius of curvature less than ten feet except at sharp edge pits of $\frac{1}{4}$ inch diameter or smaller and no other irregularities that would result in a rocking motion or a clearance exceeding $\frac{1}{4}$ inch when a ten foot long straight edge with $\frac{3}{8}$ inch diameter by $\frac{1}{8}$ inch high pin in the straight edge surface at each end is held against the surface being evaluated for smoothness. The effect of vertical curves in highways should be eliminated from the evaluation.

"Layer" of material is a homogeneous sheet of material formed in a single operation. Thus, kraft paper is one "layer" of material. If later the kraft paper is coated with homogeneous sheet of polyethylene polymer, the coated kraft becomes two "layers" of material.

"Friction coefficient" can be determined by dividing force required to restrain one end of the slab by the mass of said slab of concrete when restraining force is measured in the plane of the slab at the slab end during a 12 hour period while the average temperature of the concrete is rising at least 30° F.

"Shrinkage" is a reduction of dimension. In concrete slabs shrinkage is caused principally by reduction of concrete temperature and by evaporation of water.

"Post-tensionable cables" are described in my issued U.S. Pat. No. 3,646,748. Post-tensionable cables of that type are anchored permanently at slab extremities after tensioning. Cables used here can be of materials such as steel, nylon, glass and may be stranded as in ASTM Specification No. 416 or may be solid bars of metal, polymer or other material. Anchors are any of the several types of mono-strand or bar systems as shown in Post-Tensionings Handbook published by Post-Tensioning Institute. Hydraulic jacking equipment also is shown in the same handbook.

"Friction reducing powder" is one of several materials such as polyethylene polymer dust, mica, corn starch, fatty amides such as erucamide available from Kraft Company and "VYDAX" flurotelomer dispersion available from DuPont Company.

What is claimed is:

1. A highway pavement of the slab-on-grade type designed for smooth ridability over an extended period of time comprising a concrete slab surface layer and a non-freezing low restraint support layer, said surface layer being mounted on said support layer in such a manner as to permit freedom of longitudinal movement toward the longitudinal midpoint of said surface layer whereby said surface layer is mounted for sliding movement over said support layer in response to temperature and moisture changes in the environment thereabout, said surface layer being capable of said sliding movement in the presence of water in the environment thereabout at temperatures below the freezing point of water, said surface layer presenting a riding surface which has generally the same ridability two years after installation thereof as it does at the time of installation, low friction means being between said surface layer and said support layer to facilitate said sliding movement, a layer of sand below said surface layer, said sand layer having a concentrated dose of salt therein to function as anti-freeze means, a plurality of said surface layers disposed end to end with respect to each other, a contraction joint being at each pair of ends, said contraction joint comprising a pair of juxtaposed steel beams, each of said pair of beams being associated with a respective surface layer and extending across the width thereof to provide a steel facing above and below and at the end of each surface layer, an adjustable sealing member tightly spanning the space between said beams to maintain the space sealed from the top side of said surface layers as said beams move toward and away from each other in accordance with the expansion and contraction of said surface layers, at least one post-tensionable tendon being in at least one of said surface layers and extending to one of said beams, anchoring means associated with said one beam for anchoring said tendon after it has been tensioned, a hold-down device extending across said beams, said hold-down device comprising a bar, said beams having holes, said bar being inserted through said holes and spanning said beams, a sleeper slab below said beams, and said bar being mounted to said sleeper slab on each side of said beam.

2. The highway pavement of claim 1 wherein said surface layer has the same rideability five years after installation.

3. The highway pavement of claim 1 wherein said surface layer has the same rideability ten years after installation.

4. The highway pavement of claim 1 wherein said surface layer has the same rideability fifteen years after installation.

5. The highway pavement of claim 1 wherein said low friction means provides a coefficient of friction of less than 0.4 between said surface layer and said support layer.

6. The highway pavement of claim 5 wherein said low friction means comprises at least two layers of polymeric sheet material between said surface layer and said support layer, a film of organic liquid being between said layers of sheet material, said organic liquid having a melting point of below about −12° C. and a boiling point above about 150° C.

7. The highway pavement of claim 5 wherein said low friction means comprises a spherical particle base below said surface layer.

8. The highway pavement of claim 5 wherein said low friction means comprises a base layer made of material having low shear values, and said surface layer being on said base layer.

9. The highway pavement of claim 1 in which each of said surface layers is at least 200 feet long and has a smooth bottom surface.

10. The highway pavement of claim 1 wherein said one beam is the beam associated with said surface layer having said tendon, and said anchoring means being disposed on the side of said one beam disposed toward its surface layer.

11. The highway pavement of claim 1 wherein each of said surface layers includes at least one of said tendons, and said tendons in each of said surface layers being offset with respect to said tendons in said other surface layer across the width of said surface layers.

12. The highway pavement of claim 1 including a removable tube associated with one of said beams and extending upwardly to the top of said surface layers, and said tendon extending temporarily through said tube to facilitate the tensioning of said tendon.

* * * * *